US007832049B2

(12) United States Patent
Hollis

(10) Patent No.: US 7,832,049 B2
(45) Date of Patent: Nov. 16, 2010

(54) SNAP-TOGETHER WET NOZZLE FOR VACUUM APPLIANCE

(75) Inventor: Robert Hollis, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 12/706,454

(22) Filed: Feb. 16, 2010

(65) Prior Publication Data

US 2010/0146729 A1 Jun. 17, 2010

Related U.S. Application Data

(62) Division of application No. 12/234,454, filed on Sep. 19, 2008, now Pat. No. 7,661,175.

(60) Provisional application No. 60/973,558, filed on Sep. 19, 2007.

(51) Int. Cl.
*A47L 7/00* (2006.01)

(52) U.S. Cl. ..... 15/401; 15/121; 15/245

(58) Field of Classification Search ..... 15/121, 15/245, 401, 402; *A47L 7/00, 9/06*
See application file for complete search history.

(56) References Cited

U.S. PATENT DOCUMENTS

| | | | |
|---|---|---|---|
| 2,793,384 | A | 5/1957 | Ortega |
| 2,844,841 | A | 7/1958 | Bergquist |
| 2,857,615 | A | 10/1958 | Anderson |
| 2,867,835 | A | 1/1959 | Brown, Jr. et al. |
| 3,029,461 | A | 4/1962 | Osborn |
| 3,069,716 | A | 12/1962 | Smith |
| 3,107,387 | A | 10/1963 | Katt |
| 3,210,792 | A | 10/1965 | Sassano |
| 3,571,841 | A | 3/1971 | Crouser |
| 3,584,330 | A | 6/1971 | Wallin et al. |
| 3,950,813 | A | 4/1976 | Buck |
| 4,124,915 | A | 11/1978 | Schlicher |

(Continued)

FOREIGN PATENT DOCUMENTS

| | | |
|---|---|---|
| EP | 1 120 076 B1 | 4/2004 |

*Primary Examiner*—David A Redding
(74) *Attorney, Agent, or Firm*—Locke Lord Bissell & Liddell LLP

(57) ABSTRACT

A snap-together wet nozzle for use with a vacuum assembly is described, as well as a removable squeegee assembly for use in combination with a wet nozzle for a vacuum assembly. The snap-together wet nozzle includes an elongated, generally U-shaped nozzle housing having outwardly tapering walls, spaced apart closed ends, and a connecting tube passageway for association with a vacuum-producing means, such as a wet/dry vacuum, and further includes a squeegee assembly capable of being insertably mounted within the elongated, generally U-shaped nozzle housing. The squeegee assembly generally includes a squeegee element comprising a plurality of openings extending through the squeegee element; a first, elongated squeegee bar having spaced apart end grooves at each of its ends; and a second, elongated squeegee bar having spaced apart locking end tabs at each of its ends and a plurality of vanes spaced across the interior face of the bar, wherein when the squeegee assembly is assembled and ready for insertion into the nozzle, the squeegee element is located intermediate between the first and second squeegee bars, and wherein the first and second squeegee bars interlock by the engagement of the end tabs of the second squeegee bar with the end grooves of the first squeegee bar.

4 Claims, 8 Drawing Sheets

U.S. PATENT DOCUMENTS

| | | | |
|---|---|---|---|
| 4,864,681 | A | 9/1989 | Hult et al. |
| 5,184,372 | A | 2/1993 | Mache |
| 5,419,007 | A | 5/1995 | Hult et al. |
| 5,706,550 | A | 1/1998 | Holsten et al. |
| D392,780 | S | 3/1998 | Holsten et al. |
| 6,842,942 | B2 | 1/2005 | Morgan et al. |
| 2005/0262662 | A1 | 12/2005 | Roschi et al. |

SNAP-TOGETHER WET NOZZLE FOR VACUUM APPLIANCE

CROSS REFERENCE TO RELATED APPLICATIONS

The present application claims priority to U.S. Provisional Patent Application Ser. No. 60/973,558 filed Sep. 19, 2007, the contents of which are incorporated herein by reference in its entirety. This application is a divisional of application Ser. No. 12/234,454, now U.S. Pat. No. 7,661,175.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to wet nozzles for use with vacuum producing means, and more particularly, to a snap-together wet nozzle attachment for use with vacuum cleaners capable of wet pickup.

2. Description of the Related Art

The technology and application of vacuum suction, such as from a wet/dry vacuum cleaner or similar vacuum appliance, to nozzles containing one or more squeegee elements, is generally known. In particular, the technology and application of a vacuum to squeegees of various formats and configurations, and the associated benefits of the removal of both liquids and solid debris from a surface being cleaned are well known. Among the minimum requirements for a wet vacuum nozzle assembly include a vacuum source for aspirating both air and liquids, a housing connectable to the vacuum source at one end with an oblong suction head fitted with a narrowed intake port for increasing suction pressure at the other end, and a resilient rubber or similar squeegee blade in proximity to the intake port. In typical operation, wet nozzle attachments are attached to the end of a vacuum hose, which is in turn connected at the opposite end directly to a vacuum source, and the wet nozzle is wiped across the surface to be cleaned (which is typically already wet, or has been wetted). As the wet nozzle moves across the surface, the liquid and foreign debris on the surface are drawn towards the intake port as the vacuum source aspirates the material.

Generally speaking, as illustrated above, a wet nozzle is used with a vacuum appliance having liquid suction capabilities, so as to be able to remove water from a floor or other surface. In the typical application, the wet nozzle incorporates a squeegee portion to assist the nozzle in cleanly and efficiently removing the liquid from a surface. However, as these squeegees are often made of rubber or similar soft, flexible, elastomeric materials, they can tend to wear out or harden before the usable life of the nozzle itself has expired. Thus, many of the wet nozzles have included a method of replacing the squeegee portion. This combination of incorporating a serviceable part (the squeegee portion) and the general difficulty of cleanly lifting liquids such as water from a surface combine to make wet nozzles some of the more complex parts and accessories used in association with a wet/dry vacuum appliance.

A number of devices have been described which intend to improve or enhance the fluid debris recovery in such wet nozzle assemblies, and address some of the problems associated with these devices as described above. For example, U.S. Pat. No. 5,419,007 describes a wet nozzle assembly which requires through-pins to be fitted through a retractable core, which requires a sequenced opening of the mold to prevent damage from occurring. Additionally, replacing the squeegee section of this assembly can be difficult, and may enhance the chance for broken or damaged pins, which in turn reduce the efficiency and utility of the nozzle assembly.

A further squeegee nozzle attachment design can be found in U.S. Pat. No. 5,184,372, which describes a squeegee attachment tool for use with a wet/dry vacuum cleaner incorporating an oblong but narrow in profile suction head fitted with a very short squeegee blade providing both high suction and superior aspiration and yet reaches to the extreme edges of a cleaned surface at both the beginning and end of a cleaning stroke. Internal angled ribs coupled with an efficient vacuum chamber a narrow but deep intake port throat with side channel creates improved pressure distribution at the intake port mouth and provides significant side suction to remove liquid and debris from along and beneath adjacent surfaces and other obstructions. A specifically dimensioned and angled handle reportedly improves operator comfort and effectiveness.

This application for patent discloses an improved snap-together wet nozzle assembly for use with a vacuum producing means, such as a wet/dry vacuum appliance, wherein the assembly can be molded and manufactured in an efficient and simple manner, is easy to service, and the structure of which facilitates the replacement of the squeegee portion therein.

BRIEF SUMMARY OF THE INVENTION

Snap together wet nozzle assemblies are described herein. In accordance with one embodiment of the present disclosure, a snap-together wet nozzle for use with a vacuum-producing means, such as a wet/dry vacuum, is described, wherein the nozzle comprises an elongated, U-shaped nozzle housing having outwardly tapering walls, spaced apart closed ends, and a connecting tube passageway for association with a vacuum-producing means, and further including a squeegee assembly capable of being insertably mounted within the elongated, U-shaped nozzle housing. The squeegee assembly generally comprises a squeegee element comprising a plurality of openings extending through the squeegee element; a first, elongated squeegee bar having spaced apart end grooves at each of its ends; and a second, elongated squeegee bar having spaced apart locking end tabs at each of its ends and a plurality of vanes spaced across the interior face of the bar, wherein the squeegee element is located intermediate between the first and second squeegee bars, and wherein the first and second squeegee bars interlock by the engagement of the end tabs of the second squeegee bar with the end grooves of the first squeegee bar. In further aspects of this embodiment of the present disclosure, the squeegee assembly may comprise spaced apart vanes formed along a top face of the first squeegee bar, wherein the spaced vanes comprising upwardly directed pins in alignment with the openings in the squeegee element, such that the squeegee element engages the first squeegee bar by accepting the upwardly directing pins through one or more of its plurality of openings.

In accordance with a further embodiment of the present disclosure, a squeegee assembly insertable in a housing of a snap-together wet nozzle for use with a vacuum appliance, such as a wet/dry vacuum, is described, wherein the assembly comprises a first, elongated squeegee bar having an interior and exterior face, wherein the interior face comprises a plurality of vanes, one or more of which comprises a pin extending upwardly above the top surface of the vane; a second, elongated squeegee bar having an interior and exterior face, wherein the interior face comprises a plurality of vanes; and a squeegee element located intermediate between the first and second elongated squeegee bars. In accordance with aspects of this embodiment, the squeegee element may comprise a plurality of holes or openings, a number of which align with the upright pins on the first squeegee bar and the squeegee element to be attached to the first squeegee bar. In accordance with further aspects of this embodiment, the vanes on the first and second squeegee bars of the completed assembly form a plurality of vents in the squeegee assembly which improve the airflow into the wet nozzle during use. In yet further aspects of this embodiment, the first squeegee bar may comprise spaced apart end grooves at each of its ends, and the second squeegee bar may comprise spaced apart locking end tabs at each of its ends, such that the first and second squeegee bars may be lockably connected by inserting the locking end tabs of the second bar into the end grooves of the first bar, thereby retaining the squeegee element intermediate therebetween.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
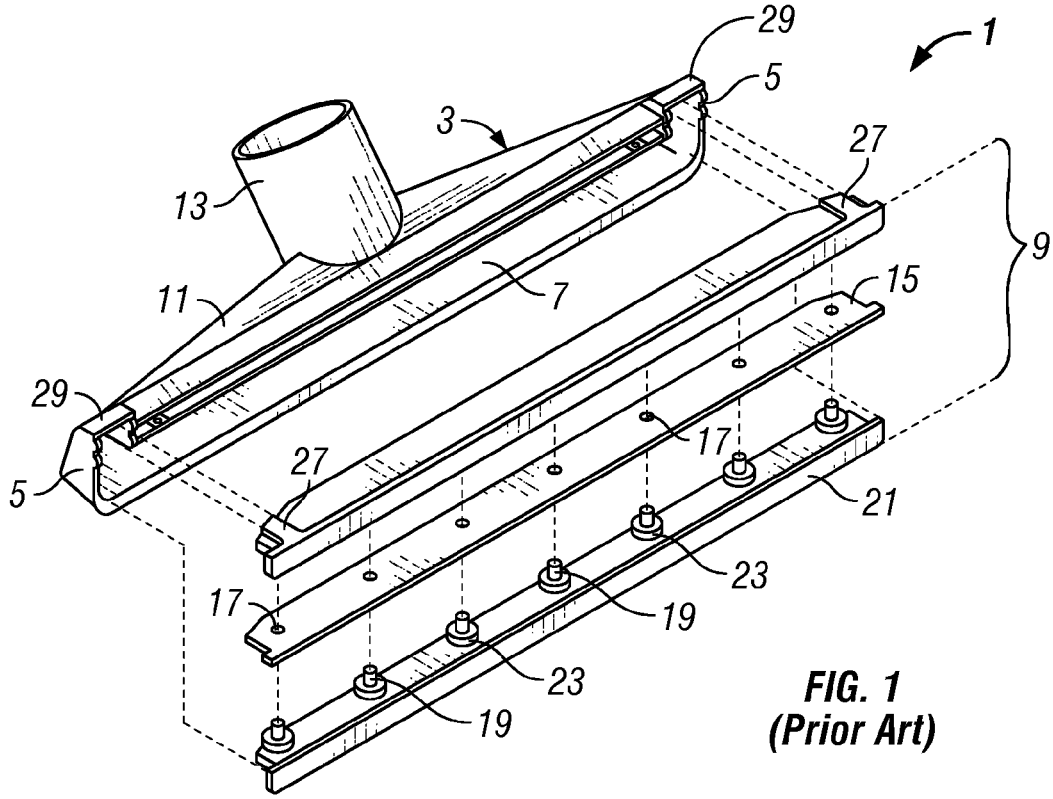
FIG. 1 (Prior Art)
FIG. 1 illustrates an exploded, perspective view of a first prior art snap-together nozzle assembly.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

In general terms, Applicants have created a wet nozzle assembly, and methods for its assembly, that has improved moldability characteristics, improved serviceability, and incorporates features that allow for improved liquid removal performance.

In order to provide a background understanding of the improved features and advantages of the snap together wet nozzle of the present invention as compared to the prior art, reference is first made to FIG. 1 of the drawings which shows a typical prior art squeegee construction. The wet nozzle 1 in FIG. 1 illustrates an elongated U-shaped nozzle housing 3 with closed ends 5. The open portion 7 of the elongated U-shaped nozzle housing 3 is adapted to receive the squeegee bar assembly 9, as will be presently described. Opposite from the open portion or area 7 of the elongated U-shaped nozzle housing 3 is a closed wall or section 11 shown to taper from each of the closed ends 5 upwardly to a tubular portion 13 which forms a connecting passageway for association with a vacuum cleaner (not shown).

The combined squeegee bar assembly 9 of the squeegee apparatus illustrated in FIG. 1 includes a squeegee element 15, typically made of rubber or the like, which includes a plurality of holes 17 for complementary mating engagement with the spaced prongs 19 of a lower squeegee bar 21. When mounted on the spaced prongs 19 of the lower squeegee bar 21, the squeegee element 15 rests upon the shoulders 23 associated with each spaced prong 19, in order to space the squeegee element 15 upwardly from the lower squeegee bar 21. Each of the spaced prongs 19 are also complementary mated within suitable prong receptacles (not shown) of the upper spacer bar 25, when the upper and lower spacer bars 21, 25 are complementary mated and assembled relative to the squeegee element 15. Following such assembly, the combined squeegee bar assembly 9 is inserted into the open portion 7 of the elongated U-shaped nozzle housing 3. In order to securely retain the combined squeegee bar assembly 9 within the open portion 7 of the elongated U-shaped nozzle housing 7, the upper squeegee bar 25 has spaced male locking sections 27, 27 which are complementary mated with corresponding female locking sections 29, 29 of the elongated U-shaped nozzle housing 3. In this way, the combined squeegee bar assembly 9 is retained within the open portion 7 of the elongated U-shaped nozzle housing 3, in order to operate as a wet nozzle for use with a vacuum cleaner (not shown).

Figure 2:
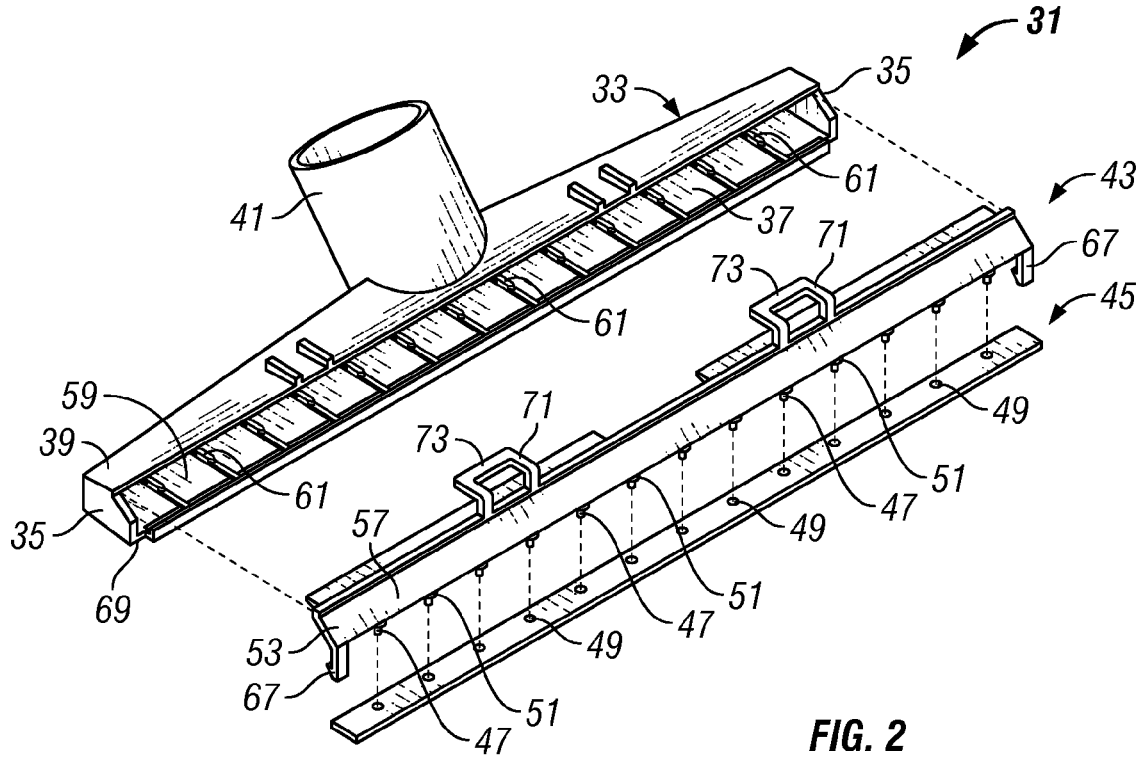
FIG. 2 (Prior Art)
FIG. 2 illustrates an exploded, perspective view of a second prior art snap-together nozzle assembly.

Another known wet nozzle assembly is illustrated in FIG. 2. The snap-together wet nozzle 31 shown in FIG. 2 includes an elongated U-shaped nozzle housing 33 of different shape than that of FIG. 1, having instead closed ends 35, 35, an open side or bottom 37 and a closed side or top 39, the latter tapering upwardly from the closed ends 35 to a tubular element 41 for association with a vacuum cleaner (not shown). The tubular element 41 communicates with the open side or bottom 37 of the U-shaped nozzle housing 33, in order to enable air and water to pass around a squeegee element and through the tubular element 41, when drawn therethrough by the vacuum cleaner (not shown).

As distinct from the FIG. 1 prior art construction, the snap together wet nozzle 31 of FIG. 2 includes a single locking squeegee bar 43 for releasably holding and locking an elongated squeegee element 45. The locking squeeze bar 43 is constructed for releasably holding and locking the elongated squeegee element 45 between the locking squeegee bar 43 and the elongated U-shaped nozzle housing 33. For this purpose, the locking squeegee bar 43 has a plurality of spaced squeegee prongs 47 for reception within spaced complementary configured openings 49 in the elongated squeegee element 45, also preferably made from a rubber or like material.

Figure 3:
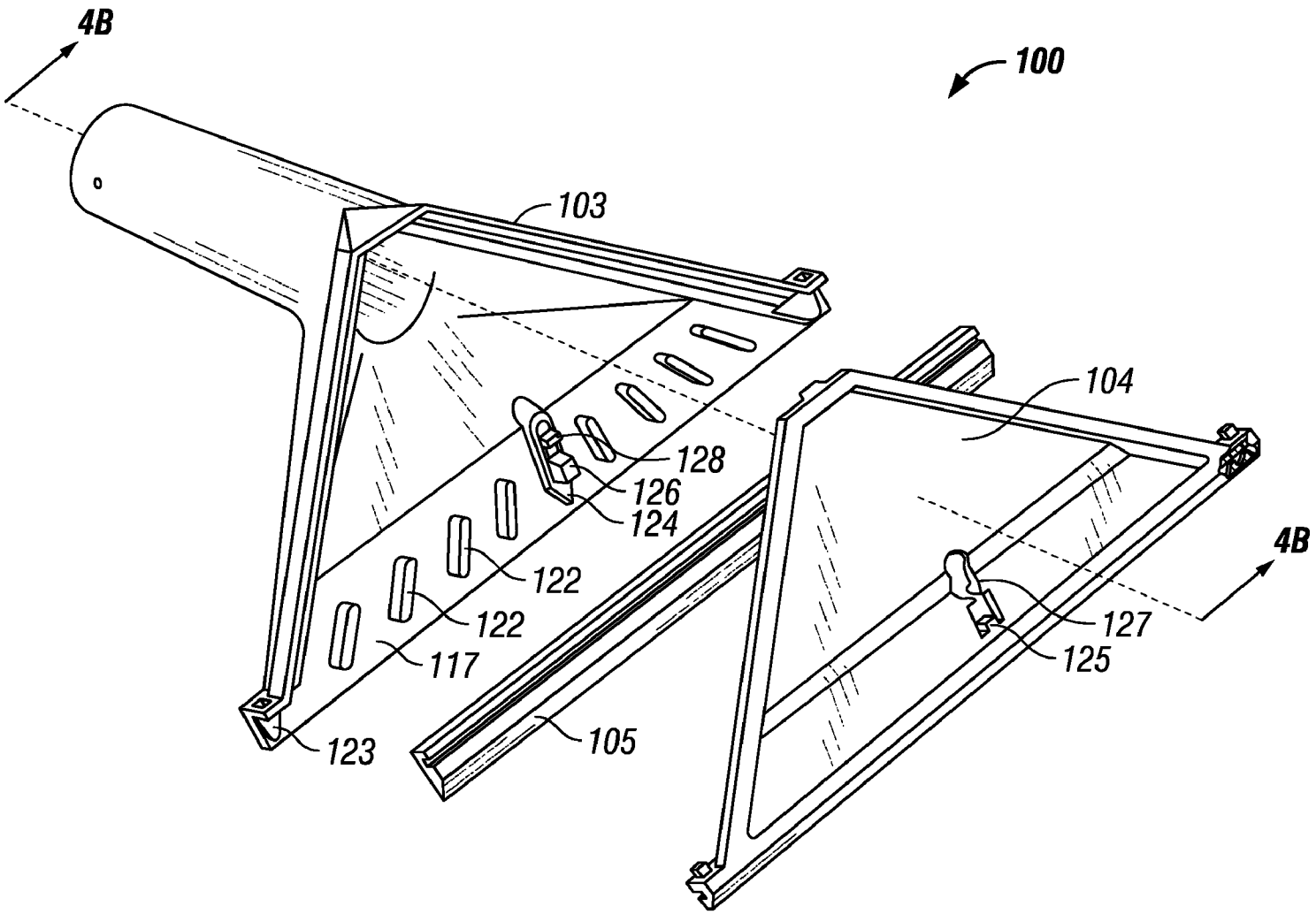
FIG. 3 (Prior Art)
FIG. 3 illustrates a further prior art, hand-held snap-together nozzle assembly.

FIG. 3 illustrates the squeegee attachment assembly 100 described in U.S. Pat. No. 5,184,372, described above. This assembly incorporates angled vents formed by ribs 122 and standoff pads 123 on the bottom surface 117 of the main body 103 in order to improve airflow and suction distribution at and along the edges of the nozzle itself, and in turn reportedly improve the overall efficiency of the attachment. However, as discussed above, the attachment of front face 104 of assembly 100 to the body 103 of the assembly via the latching mechanism 126, 128 (and associated retaining tabs 125, 127), can lead to a poor seal being formed, reducing the efficiency of the nozzle itself.

Figure 4A:
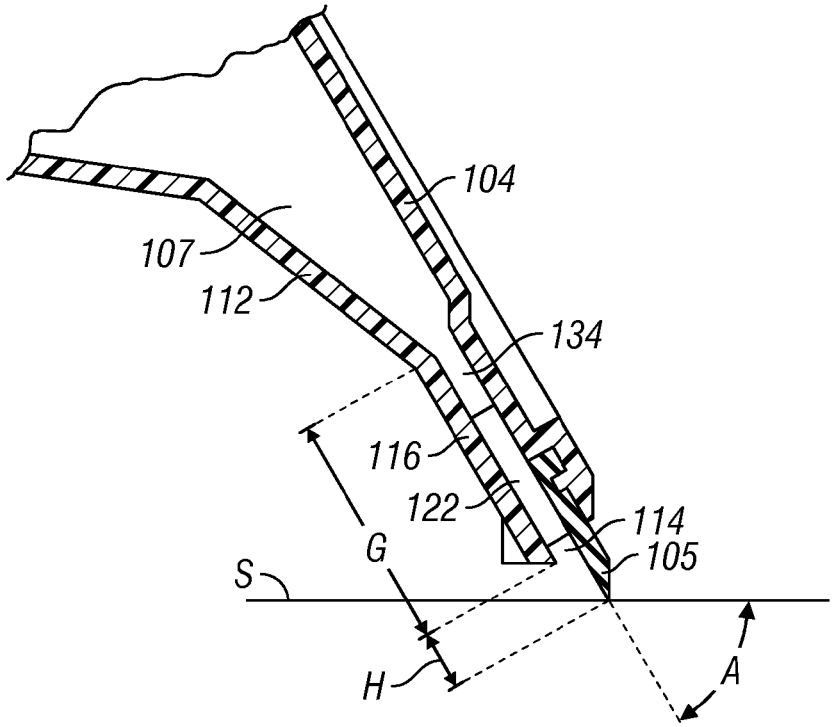
FIG. 4A illustrates an enlarged, fragmentary vertical section of the hand tool illustrated in FIG. 3.
Figure 4B:
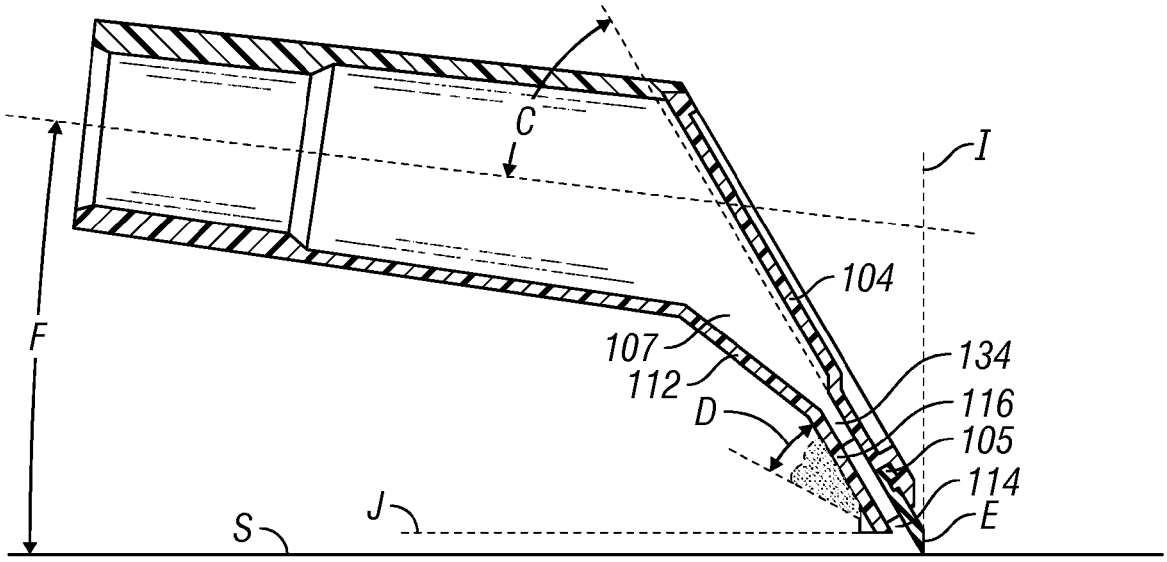
FIG. 4B illustrates an enlarged vertical section along line 3-3 of FIG. 3, looking in the direction indicated by the arrows.

FIGS. 4A and 4B are cross-sectional views of the assembly 100 of FIG. 3, taken along line 3-3, and illustrate more clearly the limiting details of the nozzle described in FIG. 3. As can be seen in FIG. 4A, the angled ribs 122 act to hold the squeegee blade 105 in place against the nozzle face 104, and intermediate between bottom wall 116 and face 104, which allows air into intake port 14, through intake throat 134, and into chamber 107 (defined by bottom wall 112 and face member 104) to flow only on one side, thereby greatly limiting the nozzle's utility in both the pull and push directions during use against surface (S). A further drawback to the prior nozzle design shown in FIG. 3 is illustrated in FIG. 4B, wherein the angle (F) of the device 100 to the surface (S) is very shallow and low to the ground, so that the tool can be used for cleaning window frames. However, this low angle of dimension (F) (in the range of 8-20°) would necessarily require an additional piece so that a user could comfortably hold the nozzle while it is operating at its optimal operating angle, measured from (I).

In comparison with the prior art constructions described above, the snap-together wet nozzle of the present disclosure, as illustrated in FIGS. 5-9, enjoys numerous features and advantages over these prior art designs, while retaining some of the more common or generic elements, as will be understood. In particular, the wet nozzle assembly of the present disclosure incorporates a plurality of angled vents into separate insert parts, which allows the vents in the nozzle assembly to be molded using simple "open and close" tooling, and provide improved airflow on both sides of the squeegee itself, thereby providing improved performance whether the nozzle assembly 200 is being pushed or pulled along a wet surface by a user. Further, the substantially single-component design of the nozzle housing 210 provides only an opening at the bottom and an attachment opening, which greatly reduces the potential for poor performance due to air leaks, such as from a compromised assembly.

Figure 5:
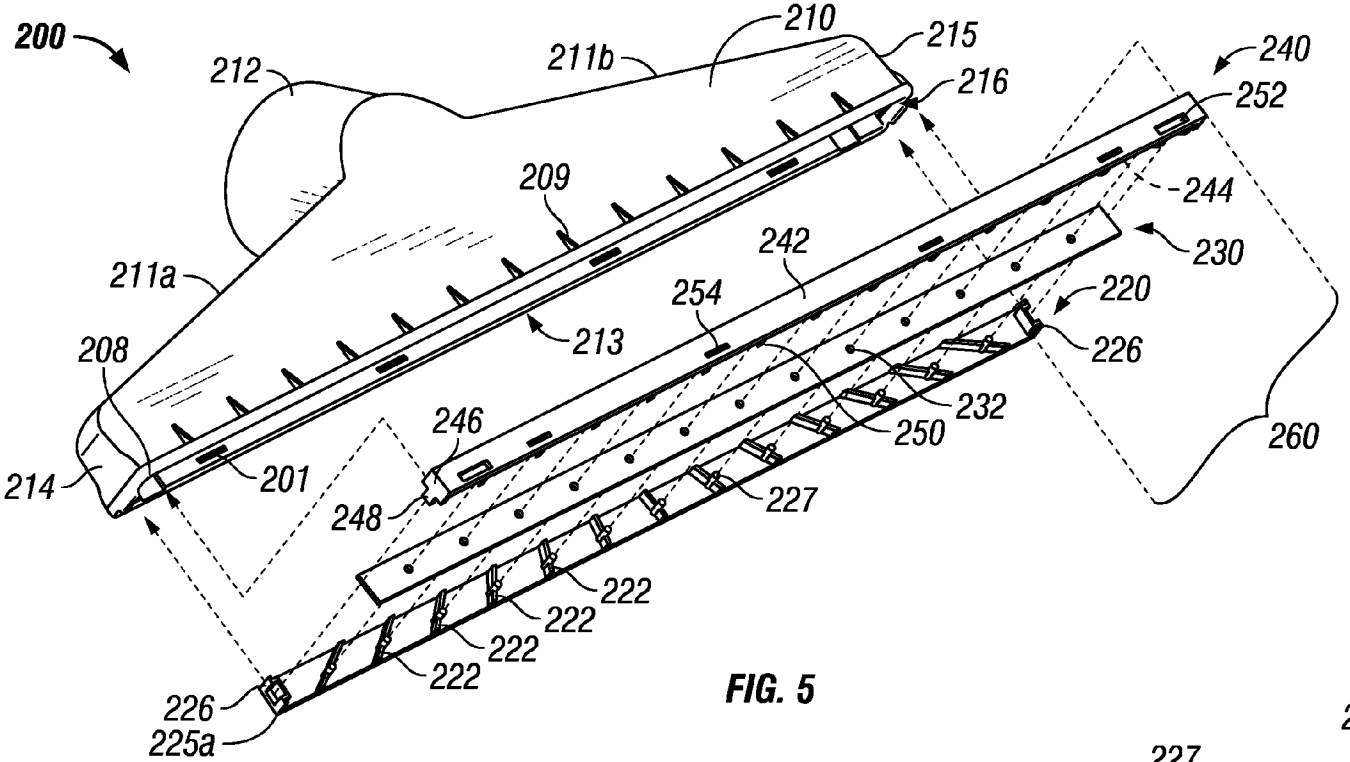
FIG. 5 illustrates an exploded view of the wet nozzle of the present disclosure.
Figure 8:
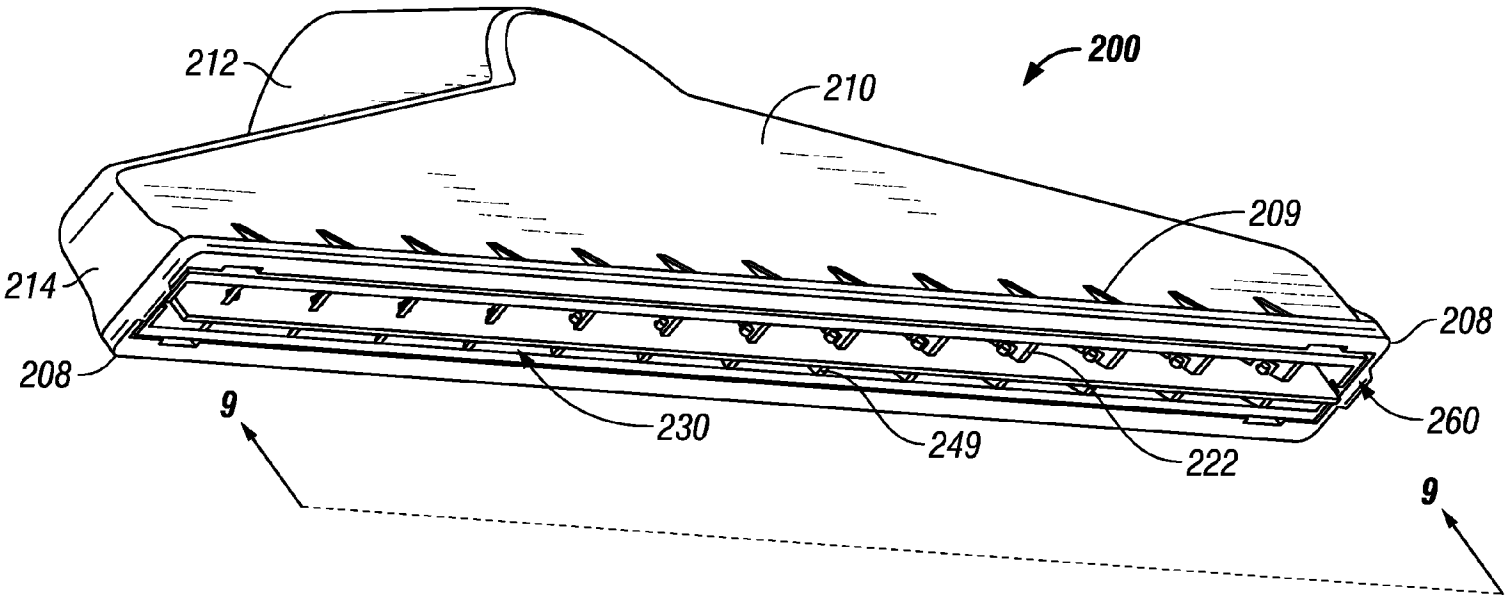
FIG. 8 illustrates a perspective, lower view of the nozzle of the present disclosure.

The snap together wet nozzle assembly 200 of the present disclosure is illustrated in the exploded, perspective view of FIG. 5. As shown therein, nozzle 200 comprises a generally elongated, substantially single-piece "U-shaped" housing 210 having upper, outwardly tapering walls 211*a*, 211*b*, an open side/bottom face 213, and spaced apart closed ends 214, 215, as best seen in FIG. 5 and FIG. 8 of the disclosure. As illustrated therein, tapering walls 211*a*, 211*b* taper outwardly from a tubular element 212 that includes a connecting passageway (not shown), for use in the association and connection of the assembly 200 with an appropriate vacuum means or assembly such as a wet/dry vacuum appliance (not shown), towards the closed ends 214, 215. As also shown in FIG. 5, the bottom face 213 has a generally rectangular peripheral shape, surrounded by the outer lower edge element 208, the rectangular peripheral shape defining an opening to the inner chamber 216 of the nozzle housing. The lower edge element 208 of housing 210 may optionally comprise a plurality of support elements 209 extending between the exterior face of housing 210 and the top face of edge element 208, in order to add strength to the open end of the nozzle assembly during its typical use in push-and-pull motions across a surface. The assembly 200 further comprises a squeegee assembly 260 which is insertable within the inner chamber 216 of nozzle housing 210, and which comprises a first vent bar 220, a squeegee element 230, and a second, upper vent bar 240 that is complimentary to bar 220, wherein the squeegee element fits intermediate between bars 220 and 240 and is locked intermediate between them when bars 220 and 240 are fit together via the cooperation of end slots 226 and locking end tabs 248 at the ends of bars 220 and 240, respectively. In accordance with the present disclosure, numerous of the components of the snap-together wet nozzle assembly 200, with the exception of squeegee element 230 as described below, may be molded from any number of polymeric, plastic materials, or alternatively may be formed from metals, such as aluminum and other lightweight metals, such as carbon-fiber materials, as appropriate.

Figure 6:
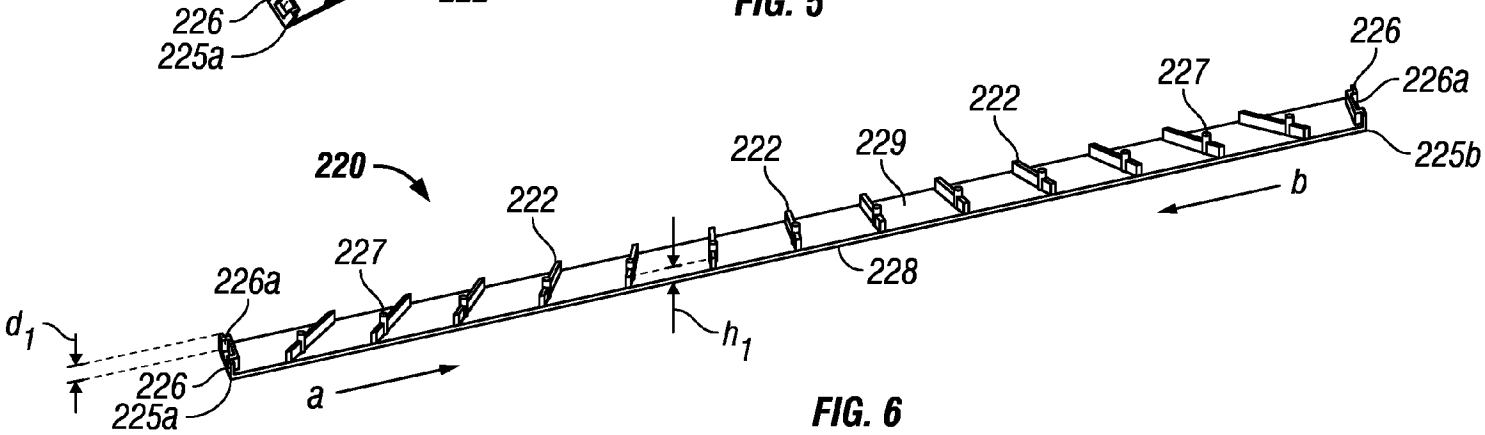
FIG. 6 illustrates an enlarged detailed view of the first insert portion shown in FIG. 5.

The squeegee assembly 260 which is insertable within the inner chamber 216 of nozzle housing 210 will now be described in more detail. Turning to FIG. 6, a detail of the first component of assembly 260, vent bar 220, is illustrated. As shown therein, vent bar 220 is a generally elongated, bar-shaped rectangular component comprising bottom and top faces 228 and 229, respectively, and longitudinally spaced-apart ends 225*a* and 225*b*. At each of the spaced-apart ends 225*a*, 225*b* are formed end slots 226, having a generally "backwards C" shape to define recessed portion 226*a*, and extending upwardly a distance $d_1$ from the top face 229 of bar 220. A plurality of vent vanes 222 are spaced across the top face 229 of bar 220, extending upward from the top face 229 a height $h_1$, which may be less than, or substantially equal to, the distance $d_1$ the end slots 226 extend upward, although in some embodiments the vanes 222 may extend upwardly to a height $h_1$ that is greater than the distance $d_1$. Each of the vent vanes 222 on bar 220 further comprise an upwardly extending pin 227, which extends upward a distance such that the overall height of the pin 227 taken from the top face 229 is greater than the height $h_1$ of the vanes 222. Each of the pins 227 are preferably of a substantially cylindrical shape, although they may of any appropriate geometric shape desired, e.g., square, hexagonal, etc. As shown in FIG. 6, each of the vent vanes 222 may be oriented in a variety of angles, in order to obtain optimal air flow into and through the nozzle 200. Accordingly, the angles of orientation may range from about 1° to about 175°, for example from about 5° to about 90°, inclusive, relative to the ends 225*a*, 225*b*, and any one or more of which may optionally be oriented substantially perpendicular to ends 225*a*, 225*b*. As illustrated in the embodiment of FIG. 6, bar 220 comprises a central vane 222' that is substantially parallel with ends 225*a* and 225*b*, and wherein the vanes 222 extending between ends 225*a*, 225*b* and central vane 222' are each of a different angle. In one non-limiting example, the vanes 222 located between end 225*a* and central vane 222' of bar 220 have orientation angles (going in the direction of arrow 'a') of about 25°, about 30°, about 35°, about 45°, about 55°, and about 75(±5°), and the vanes located between end 225*b* and central vane 222' of bar 220 have orientation angles (going in the direction of arrow 'b') of about 155°, about 150°, about 145°, about 135°, about 125°, and about 105 (±5°).

Figure 7A:
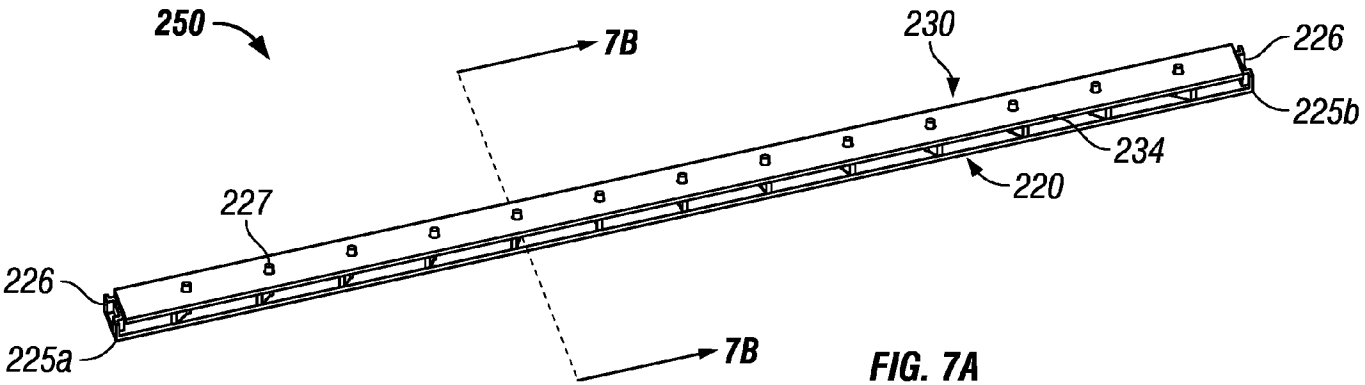
FIG. 7A illustrates the insert portion of FIG. 6 with a squeegee mounted in place.
Figure 7B:
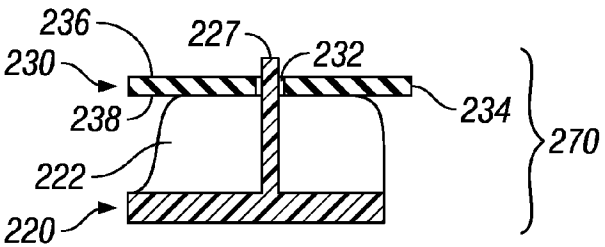
FIG. 7B illustrates a sectional view of the assembly of FIG. 7A, as viewed along line 7-7.

FIG. 7A illustrates a perspective view of a partially assembled squeegee assembly 250, comprising the vent bar 220 and squeegee element 230. As shown therein, squeegee element 230 is of a generally elongated, rectangular shape having an overall length less than that of the overall length of vent bar 220. Squeegee element 230 also comprises a plurality of perforations, or openings, 232, which allow it to be attached to bar 220 via insertion of pins 227 on the top of vanes 222 through holes 232. This is shown in greater detail in the sectional-view of the snap-together assembly 270, taken along line 7-7 and illustrated in FIG. 7B, depicting how in accordance with aspects of the present disclosure, squeegee element 230 mounts to the top face of directional vanes 222 via pins 227, which may be integrally-formed within vanes 222 during the molding process of bar 220.

Squeegee element 230, alternatively referred to as a squeegee blade, is generally an elongated, rectangular-shaped element, suitable for scraping and clearing water and other liquids from a surface, such as a floor, using a vacuum-producing means. The squeegee element as illustrated in the Figures herein typically has a top face 236 and a bottom face 238, as well as a plurality of openings 232 spaced longitudinally along its length and extending through the squeegee element itself Squeegee element 230 is preferably formed of one solid piece of material, although in some instances it may be desirable to have the element 230 comprised of several separate pieces that when coupled with portions 220 and 240 described herein form a whole squeegee element. Further, the squeegee blade 230 may be made of any suitable flexible material, including but not limited to elastomers and rubbers such as polyisoprene, polybutadiene, polyisobutylene, styrene butadiene, and polyurethanes; nitrile rubbers (copolymers of polybutadiene and acrylonitrile, NBR), also called buna N rubbers; hydrated nitrile rubbers (HNBR), such as THERBAN® and ZETPOL®; copolymers of polyethylene and polypropylene; terpolymers, such as terpolymers of polyethylene, polypropylene and a diene-component; polyether block amides; ethylene vinyl acetate (EVA); fluoro- and perfluoro-elastomers; polysulfide rubbers/elastomers; thermoplastic elastomers; fluoro-silicone rubbers; and silicon-comprising materials that are flexible and suitable for use in the applications described herein. Additionally, and in accordance with aspects of the present disclosure, squeegee blade 230 may have a substantially flat edge for engaging a surface during use, or may be formed with a sharp floor engaging edge 234 that extends transversely along a length of the squeegee blade itself, wherein the engaging edge 234 extends forwardly from the lower edge element 208 of the nozzle assembly, and which corresponds at least to the lateral width of the squeegee assembly 260.

Figure 7C:
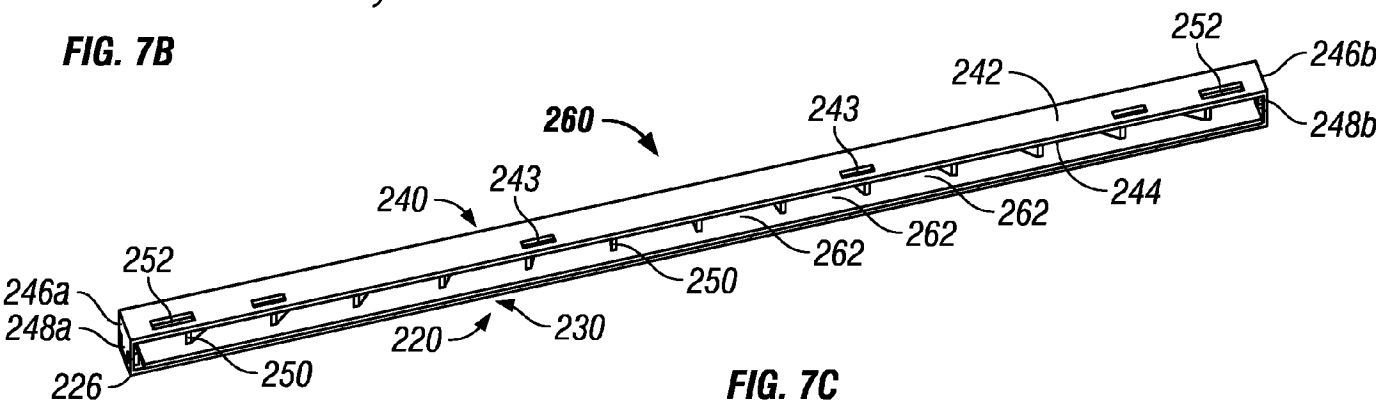
FIG. 7C illustrates a general squeegee assembly for use in a nozzle of the present disclosure.

FIG. 7C illustrates the squeegee assembly 260 fully assembled, prior to insertion within the interior portion 216 of nozzle housing 210. As shown therein, the second, elongated vent bar 240 comprises an outer face 242 and an inner face 244, as well as longitudinally spaced-apart ends 246*a* and 246*b*. Vent bar 240 may further comprise one or more, preferably two, slots or indents 252 which, when the assembly 260 is inserted into the interior of nozzle housing 210, allow for assembly 260 to be removed from the interior of the housing by way of a screwdriver or other, suitable tool. Such slots or indents 252 may be located at the ends and/or middle region of the assembly 260, as appropriate, and depending upon the length of assembly 260. The outer face 242 of bar 240 (and similarly on the outer face of bar 220, not shown) also comprises a plurality of outwardly-extending tabs 243 which, during insertion of the nozzle assembly 260 into the interior region 216 of nozzle housing 210, align with inwardly-extending indents 201 formed into the interior wall of housing 210, allowing for assembly 260 to be lockably engaged in position within housing 210. As can also be seen in FIG. 7C, and as is illustrated more clearly in FIG. 9 (below), the inner face 244 has a plurality of vent vanes 250 spaced across the inner face of bar 240, extending downwardly from the inner face. Preferably, these vent vanes will substantially align with vent vanes 222 on the corresponding vent bar 220 when assembly 260 is assembled, with squeegee element 230 intermediate between the first vent bar 220 and the second vent bar 240. As suggested before, the presence of the vent vanes 222, 250 not only allow for improved air flow through the nozzle 200 during use, but also act to stabilize intermediately-located squeegee 230 between the two vent bars of the assembly 260, giving it added rigidity and contributing to its increased efficiency, lifetime, and resistance to pull-out during use.

Figure 7D:
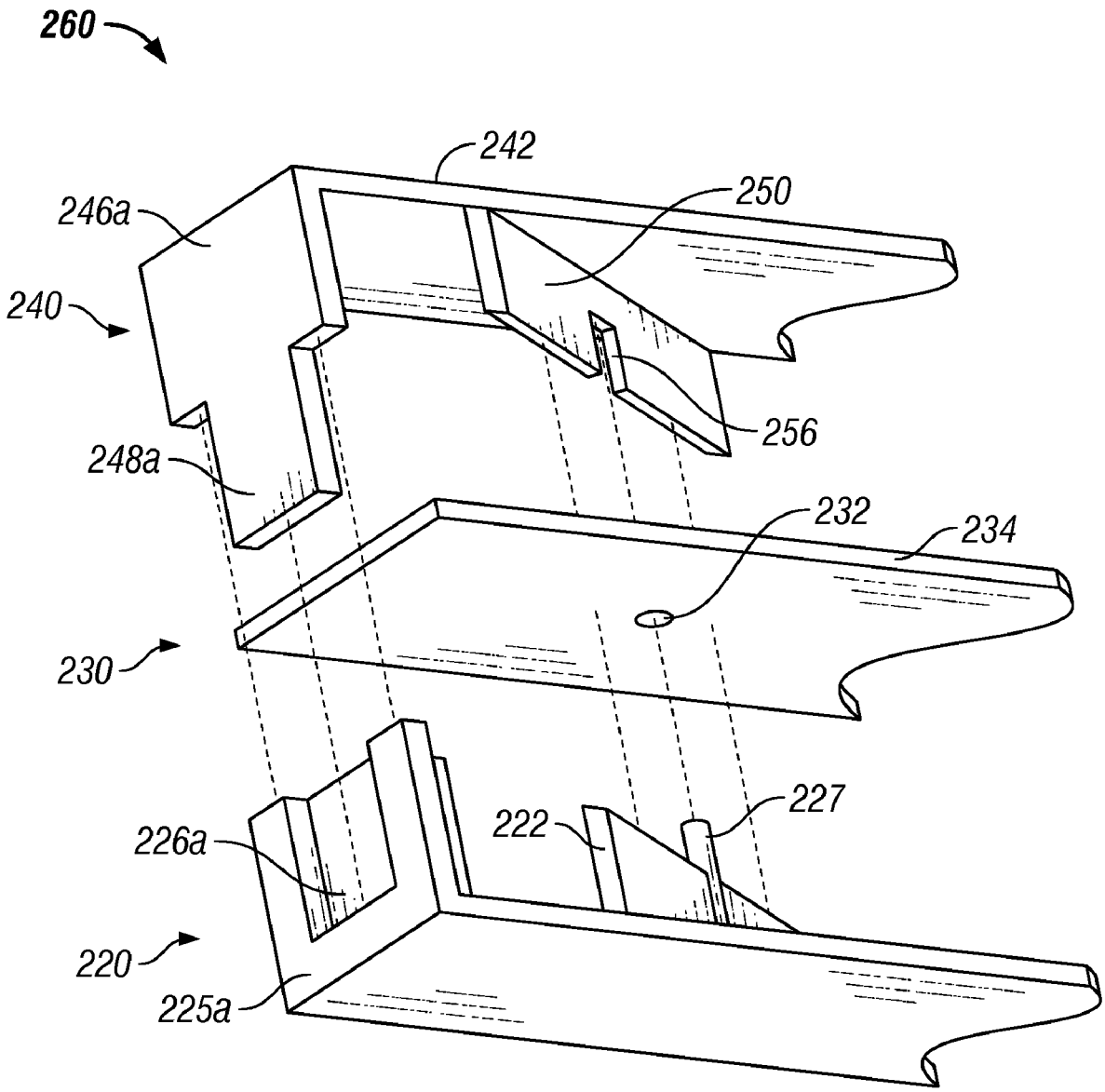
FIG. 7D illustrates an exploded end view of a squeegee assembly in accordance with the present disclosure.

As is further illustrated in FIG. 7C, when squeegee assembly 260 is complete, bars 240 and 220 are locked together with squeegee element 230 intermediate between them via the locking mechanism formed by end slots 226 and locking end tabs 248*a*, 248*b*, such that tabs 248*a*, 248*b* slidably insert into the recessed portions 226*a* of end slots 226 and form a locked assembly, and in combination with the pins 227 extending through openings 232 in squeegee element 230, thereby releasably retaining the squeegee element 230 intermediate between the bars 240 and 220. This is shown in the exploded side view of assembly 260 illustrated in FIG. 7D, wherein it is shown that during assembly bars 220 and 240 mate together such that the end tabs 248 on bar 240 slidably, and in certain embodiments lockably, engage the recessed portions 226*a* of end slots 226 in bar 220 and form a flush face. In accordance with this aspect of the disclosure, tabs 248 and recessed portions 226*a* may be sized the same on both ends (e.g., ends 225*a* and 225*b* have recessed end portions 226*a* of the same size), or they may be of different size (e.g., the slot at end 225*a* may be narrower than the slot at end 225*b*), the latter embodiment allowing for easier orientation of the assembly 260 by the user when taking it apart and putting it back together when replacing or repairing a squeegee element 230. As is also illustrated in FIG. 7D, the vent vanes 250 on bar 240 may further comprise a formed opening 256, so as to allow the terminal ends of pins 227 to be inserted into, and retained within, the body of each of the respective vanes 250. This in turn adds additional support and strength to the assembly, and aids in preventing unwanted breakage of pins 227.

When it is time for a user to change out the squeegee element 230, they may simply squeeze the locking mechanism together using any appropriate means, or pull it apart, in order to release the two bars 220 and 240 from each other, thereby allowing for ready access to the squeegee element 230 to be changed out. Upon replacement, the assembly is put back together as described above, and insertably engaged with the interior of the nozzle housing 210.

Figure 9:
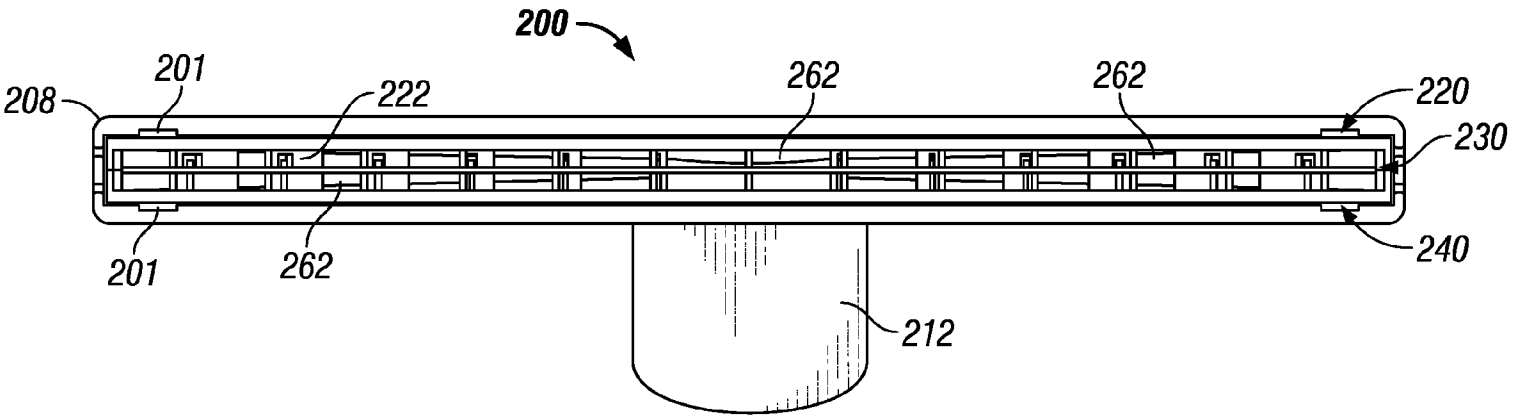
FIG. 9 illustrates a bottom view of the nozzle of FIG. 8, viewed along line 9-9.

FIG. 8 illustrates a perspective view of the complete nozzle assembly 200 of the present disclosure, with squeegee assembly 260 inserted into the interior portion of nozzle housing 210. As can be seen therein, once assembly 260 has been inserted into the nozzle housing 210, it is substantially flush with the bottom plane defined by the lower edge 208 of housing 210, while the generally horizontally-disposed squeegee element 230 may be integral with, or equally acceptable, may extend outward a distance from the plane of the lower edge 208. In this manner, in use, as the nozzle assembly 200 is pulled or pushed along a surface, such as a floor, the squeegee element 230 pushes or pulls liquid to be vacuumed, while the vanes on both the top and bottom faces of the element 230 enable air and liquid to pass around the squeegee element 230 and through the assembly 200 into the vacuum appliance (not shown). FIG. 9 is a bottom view into the nozzle assembly 200 described herein, viewed along line 9-9 of FIG. 8, and illustrating the placement of squeegee assembly 260 within the lower opening 216 of housing 210. As can be seen from this view, the array of angled vents forming a plurality of angled, vented air passages 262 along both sides of the squeegee element 230, which provides increased air flow into and through the assembly. FIG. 9 also illustrates more clearly an exemplary spaced relationship of slots 201, for use in the removal of squeegee assembly 260 from nozzle 200 using an appropriate hand-tool, such as a flat-bladed screwdriver, a knife blade, or the like. In a typical, non-limiting scenario, wherein the user wants to replace the squeegee element 230 due to wear, aging, efficiency, or other reasons, the user simply inserts the head of a flat-bladed screwdriver or the like into slot 201 and leverages the squeegee assembly 260 out of nozzle 200. Squeegee assembly 260 may then be disassembled by compressing the ends of the assembly together so as to release the end tabs 248 of top piece 240 from the end slots 260 of bottom piece 220, thereby allowing access to squeegee element 230 directly. The squeegee element may then be removed from lower portion 220, and a new squeegee may be inserted by arranging it on top of angled vent elements 224 in a manner such that standing pins 227 on vane elements 224 extend upwardly through the spaced apart perforations 232 in squeegee element 230. The assembly 260 is then re-assembled as discussed above, re-inserted into nozzle 200, and use of the nozzle may then resume as normal.

Figure 10:
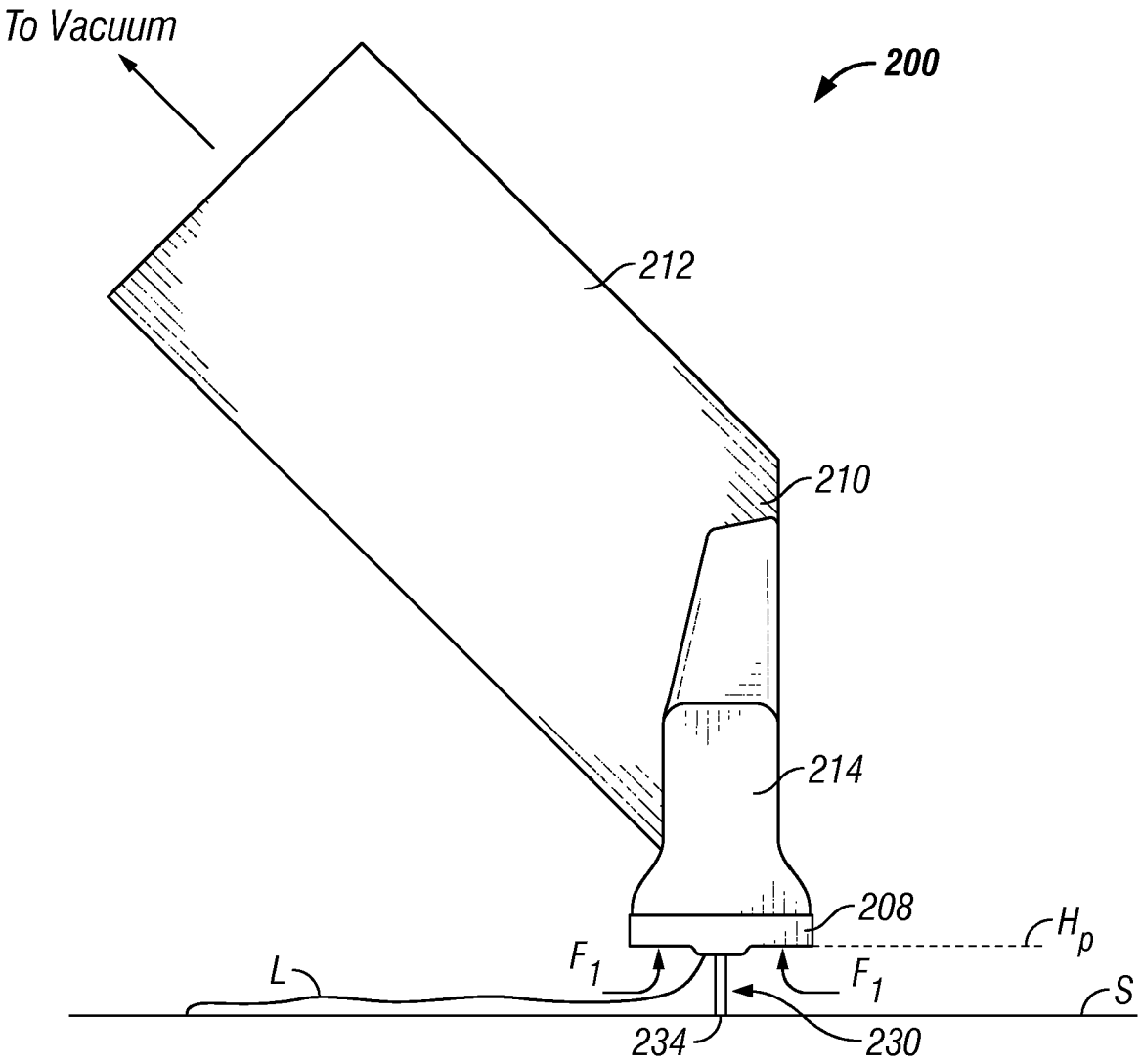
FIG. 10 illustrates a side elevational view of the wet nozzle assembly 200 shown in FIG. 5.

FIG. 10 is a side elevational view of the wet nozzle assembly 200 shown in FIG. 5, showing exemplary engagement with a surface (S) and pickup/clean-up of a liquid (L) on the surface. As shown therein, the floor-engaging edge 234 of squeegee element 230 may extend outwardly from the bottom face of the plane $H_P$ defined by the bottom of lower edge element 208. As also illustrated in FIG. 10, as the assembly 200, connected to a vacuum appliance (not shown) via tubular vacuum connection element 212, is moved along a surface (S) during standard operation, the vacuum appliance creates an air flow $F_1$ on both sides of squeegee element 230, which allows for greater efficiency in debris (both solid and liquid) pickup.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A squeegee assembly insertable in a housing of a snap-together wet nozzle for use with a vacuum appliance, the assembly comprising:

a first, elongated squeegee bar having an interior and exterior face, wherein the interior face comprises a plurality of vanes, one or more of which comprises a pin extending upwardly above the top surface of the vane;

a second, elongated squeegee bar having an interior and exterior face, wherein the interior face comprises a plurality of vanes; and a squeegee element located intermediate between the first and second elongated squeegee bars.

2. The squeegee assembly of claim 1, wherein the squeegee element comprises a plurality of holes, a number of which align with the upright pins on the first squeegee bar and the squeegee element to be attached to the first squeegee bar.

3. The squeegee assembly of claim 1, wherein the vanes on the first and second squeegee bars of the completed assembly form a plurality of vents in the squeegee assembly which improve the airflow into the wet nozzle during use.

4. The squeegee assembly of claim 1, wherein the first squeegee bar further comprises spaced apart end grooves at each of its ends, and the second squeegee bar further comprises spaced apart locking end tabs at each of its ends, such that the first and second squeegee bars may be lockably connected by inserting the locking end tabs of the second bar into the end grooves of the first bar.

* * * * *